US006098759A

United States Patent [19]

Rossman et al.

[11] Patent Number: 6,098,759

[45] Date of Patent: Aug. 8, 2000

[54] HYDRAULIC ELEVATOR

[75] Inventors: Eileen W. Rossman, Carlisle; Karl B. Orndorff, Gettsburg, both of Pa.; Scott C. Conrey, Coppell, Tex.

[73] Assignee: Inventio AG, Hergiswil, Switzerland

[21] Appl. No.: 09/301,170

[22] Filed: Apr. 28, 1999

[30] Foreign Application Priority Data

May 8, 1998 [EP] European Pat. Off. ..... 98108381

[51] Int. Cl.[7] ..... B66B 9/04; F15B 15/16

[52] U.S. Cl. ..... 187/272; 187/253; 187/401; 187/411

[58] Field of Search ..... 187/250–253, 187/272, 274, 275, 401, 411, 414; 92/77, 165 R

[56] References Cited

U.S. PATENT DOCUMENTS

| | | | |
|---|---|---|---|
| 304,823 | 9/1884 | Hutchinson | 187/253 |
| 1,060,907 | 5/1913 | Kirn | 187/411 |
| 1,620,305 | 3/1927 | Van Emon | 187/411 |
| 3,065,738 | 11/1962 | Loughridge | 92/77 |
| 3,650,356 | 3/1972 | Brown | 187/274 |
| 3,942,458 | 3/1976 | Hankin | 187/272 X |
| 3,954,157 | 5/1976 | Atkey | 187/272 |
| 4,041,845 | 8/1977 | Mean et al. | 187/272 X |
| 4,201,053 | 5/1980 | Atkey | 60/459 |
| 4,206,684 | 6/1980 | Gosney et al. | 92/165 R |
| 4,225,014 | 9/1980 | Wheeler | 187/411 |
| 4,316,316 | 2/1982 | Kappenhagen | 92/77 X |
| 4,361,208 | 11/1982 | Jackson et al. | 187/401 |
| 4,361,209 | 11/1982 | Kappenhagen et al. | 187/272 |
| 4,479,633 | 10/1984 | McCreery | 254/93 R |
| 4,667,775 | 5/1987 | Stern | 187/272 |
| 5,653,311 | 8/1997 | Heikkinen et al. | 187/272 X |

FOREIGN PATENT DOCUMENTS

| | | | |
|---|---|---|---|
| 717693 | 1/1932 | France | 187/272 |
| 52-51648 | 4/1977 | Japan | 187/272 |
| 463 745 | 11/1968 | Switzerland . | |
| 96 535 | 3/1898 | United Kingdom . | |
| 2 104 477 | 3/1983 | United Kingdom . | |

*Primary Examiner*—Robert P. Olszewski
*Assistant Examiner*—Thuy V. Tran
*Attorney, Agent, or Firm*—Cohen, Pontani, Lieberman & Pavane

[57] ABSTRACT

A hydraulic elevator having a hydraulic jack which acts directly on the elevator car. To reduce the amount of building work associated with this elevator concept, the hydraulic jack projects through the car floor into the car. The jack and the car are fastened together at the car floor by a supporting plate attached to the jack cylinder. If the jack is fitted with a mechanical synchronization device, the ends of the ropes or chains which until now have been fastened to the building also pass upwards through the car to a crossbeam to which they are fastened.

9 Claims, 3 Drawing Sheets

HYDRAULIC ELEVATOR

BACKGROUND OF THE INVENTION

1. Field of the Invention

The invention relates to a hydraulic elevator.

2. Discussion of the Prior Art

Elevators of this type are already known. They can be classified into three different types of construction, depending on how the elevator car is fastened to the hydraulic jack.

A common arrangement is for the car to rest on a platform on the end face of the jack. A disadvantage of this configuration is the large amount of space required by the retracted jack. In addition to this arrangement with the jack under the car, there is the so-called rucksack arrangement, in which the jack passes behind the car and acts on the upper part of a frame which carries the car. The point of attachment is defined by the prescribed height of the upper part of the frame. Consequently, depending on the type of car and the specified height of attachment to the upper part of the frame, a jack with a correspondingly long cylinder is required. In some cases an additional extension to the cylinder is used for this purpose, or an extra long cylinder is chosen, to meet the requirements for attachment.

Finally, the third type of construction is disclosed in the unexamined German patent application DE-OS 2062161. With this arrangement, a supporting framework and the car together form a self-contained module which is pre-assembled and needs only to be placed in position at the installation location. Two guide rails at the sides are joined together at their upper ends by means of a crossbeam to form the supporting framework. The upper ends of two telescopic jacks are attached to the crossbeam, while the lower ends of the telescopic jack are fixed at the car. The jacks are accommodated together with the guide rails in recesses on opposite sides in the car walls. The pistons of the jacks are fixed rigidly to the crossbeam, and the lower ends of the cylinders are bolted to lateral projections from the floor of the car. As the piston is fastened to the crossbeam, the cylinder and the car fastened to it rise when pressure is applied.

Although this type of hydraulic drive for elevators avoids the need for hollowed out spaces below the floor of the lowest landing, and long overtravel at the upper end of the hoistway, it nevertheless has the disadvantage that it is only suitable for elevator installations with a limited travel height. The hydraulic jacks are also especially costly, as it is essential for their cylinders to be at least as long as the intended hoisting distance.

SUMMARY OF THE INVENTION

Accordingly, it is an object of the present invention to provide an elevator installation with a hydraulic drive which is simply constructed, which can be installled with minimal effort, and which is independent of the travel height to be served.

Pursuant to this object, and others which will become apparent hereafter, one aspect of the present invention resides in a hydraulic elevator comprised of a car having a floor, at least one door, a guide rail along which the car is guided, a hydraulic jack having a cylinder and at least one piston which is telescopically extendable from the cylinder, and means for fastening the cylinder to the floor of the car so that the car moves with the cylinder in its direction of travel. The car floor has an opening therein through which the telescopic jack projects into the car.

The essence of the invention is that the hydraulic jack projects through the floor of the car into the car, the jack and the car being joined together at the car floor. Depending on the length of the jack in its retracted state, which depends on the travel height, the jack projects either into the car, or through it and out of the car roof. This makes it possible to use jacks with a greater compression length, and therefore longer travel. For applications with limited travel height, hydraulic jacks can be chosen with a cylinder length less than was previously necessary to fasten them to the car. As a result, it is now possible to select a jack independent of the length available for its installation, and there is also no need for the previously required cylinder extensions, which reduces costs.

If the jack passes through the car close to the front of the car, which is anyway covered by the open door, there is hardly any reduction in the space inside the car. An additional advantage of this arrangement is the resulting location close to the edges of the car. These areas of high structural rigidity are especially suitable for transmitting the load-bearing forces from the fastening device into the car. So as to transmit these forces to the car structure over as large an area as possible, the fastening device includes a supporting plate, which is positioned essentially at right angles to the longitudinal axis of the cylinder, and whose position on the cylinder in the direction of travel is fixed.

Besides the advantage of transmitting the forces in this way, an additional advantage is that the car rests more or less on the surface of the supporting plate, and simple means of fastening are therefore adequate to hold it in position.

It is especially easy to mount and fasten the supporting plate on the cylinder if the supporting plate has a centrally positioned opening, corresponding approximately to the cross sectional area of the cylinder, and needs only to be pushed onto the cylinder. To align the supporting plate perfectly perpendicular relative to the longitudinal axis of the cylinder, it has proved very helpful to use a guide. This can, for example, consist of a short length of pipe, which at one end is aligned coaxially with the opening and fastened to the supporting plate, and at the other end pushed onto the cylinder, which has the same diameter. A low-cost version of the supporting plate, which also saves weight, consists of a welded construction, for which available semifinished products can be used. The necessary rigidity is obtained by mounting elements in the form of gussets on the side of the plate facing away from the car to stiffen the structure.

A further embodiment of the invention especially suitable for hydraulic elevators with a long hoisting travel, uses a jack having two or more pistons which can be extended telescopically from a cylinder which is fitted with a mechanical synchronization device of a type already known, and which causes the extended lengths of adjacent telescopic parts to be equal at any position of extension. The connectors for the synchronization device also pass by one of their ends through the opening in the floor of the car together with the telescopic jack, and are fastened in position at an appropriate height. This version dispenses with the points of attachment to the hoistway walls which were previously conventional. In another embodiment of the invention, fastening points of this kind are entirely dispensed with. In this embodiment all the free ends of the connectors are pulled up to the upper end of the hoistway and fastened to a crossbeam. The crossbeam joins two guide rails for the car, which are located to the side of the telescopic jack. This version of the multi-story elevator is also constructed as a single module which is delivered pre-assembled and needs only to be placed in position.

A further version, which is very compact, has a synchronization device for harmonizing the travel of the cylinders of the telescopic jack and also a special arrangement of the rope sheaves or toothed pulleys over which the connectors run, which is a special feature of this version. The axes of these pulleys, when viewed in the horizontal plane, are arranged so as to form an acute angle relative to an imaginary line connecting the two laterally positioned guide rails. By taking this measure, and by positioning the connectors correspondingly, it is possible to significantly reduce the distance between the ends of the connectors that pass through the car and the telescopic jack, which also makes it possible to reduce the dimensions of the opening in the floor of the car, and of the entire space through which the connectors pass.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
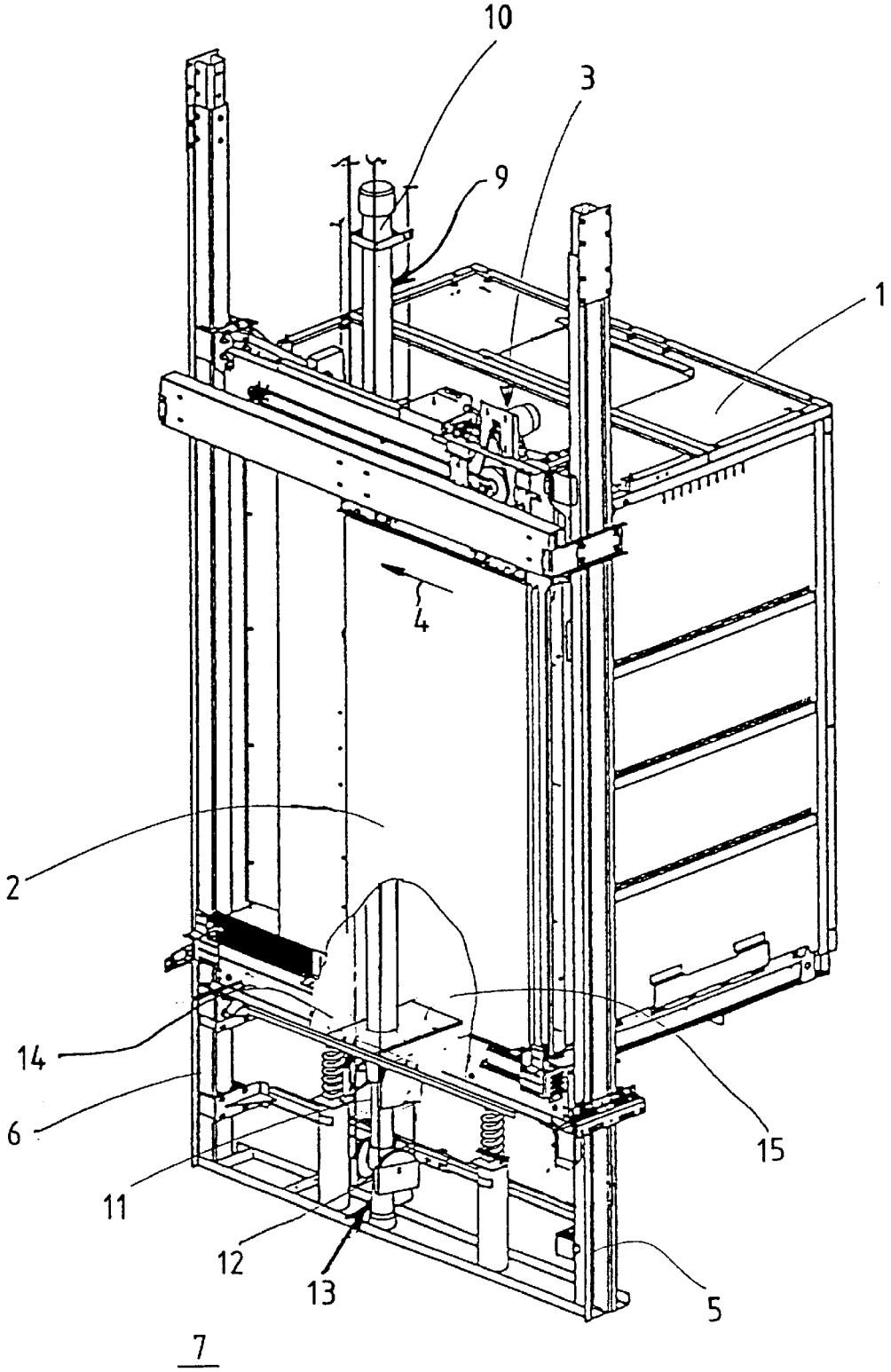
FIG. 1: is a perspective view of an elevator installation with a telescopic jack with a synchronization device, pursuant to the present invention.

FIG. 1 shows a hydraulic elevator installation with a self-supporting car 1. In a well known manner, a telescopic door 2 is fitted on the front side of the car 1, and in response to an appropriate control signal, can be retracted laterally in the direction of the arrow 4, or extended in the direction opposite to the arrow 4 by means of a door drive 3 positioned above the door. The complete car 1 is held between two guide rails 5, 6 positioned on opposite sides and permanently fastened to the building (not shown), and by means of a telescopic jack 9 can be moved along their vertical direction along the hoisting path.

The telescopic jack 9 consists essentially of a cylinder 10, a middle piston 11, and an end piston 12, the middle piston 11 and the end piston 12 being telescopically extendable out of the cylinder 10. The telescopic jack 9 is a so-called synchronized jack which is fitted with a synchronization device, which causes the lengths of adjacent parts of the telescope 10, 11 and 12 to be equal at any position of its travel. This is described in more detail below in relation to FIG. 2.

The telescopic jack 9 is fastened by the end face of the end piston 12, and by means of a jack console 13, to the floor 7 of the hoistway and runs essentially parallel to the guide rails 5, 6. The cylinder 10 of the jack 9 passes through the front part of the car close to the door 2, and depending on the length required, projects freely and unhindered for an unlimited distance above the car 1. The car 1 rests with the underside of the car floor 14 on the supporting plate 15 to which it is fastened with wheel studs/screws 16. Isolating material can also be inserted between the supporting plate 15 and the car floor to prevent transmission of vibration to the car.

In this connection it is especially advantageous to use wheel studs/screws 16 which have a self-centering head and are secured against turning. When the screws are tightened, the centering on the head of the screws 16 eliminates any play in the screw holes, and automatically aligns the telescopic jack 9 in relation to the car 1 and the guide rails 5, 6. The supporting plate 15 is either welded or permanently fastened by other appropriate means onto the end of the cylinder 10 facing the floor 7 of the hoistway. The height at which the supporting plate 15 is fixed depends on the length of overtravel, the length of the hoistway, the traveling speed of the elevator, the number of telescopic piston stages 12, 11, etc.

Figure 2:
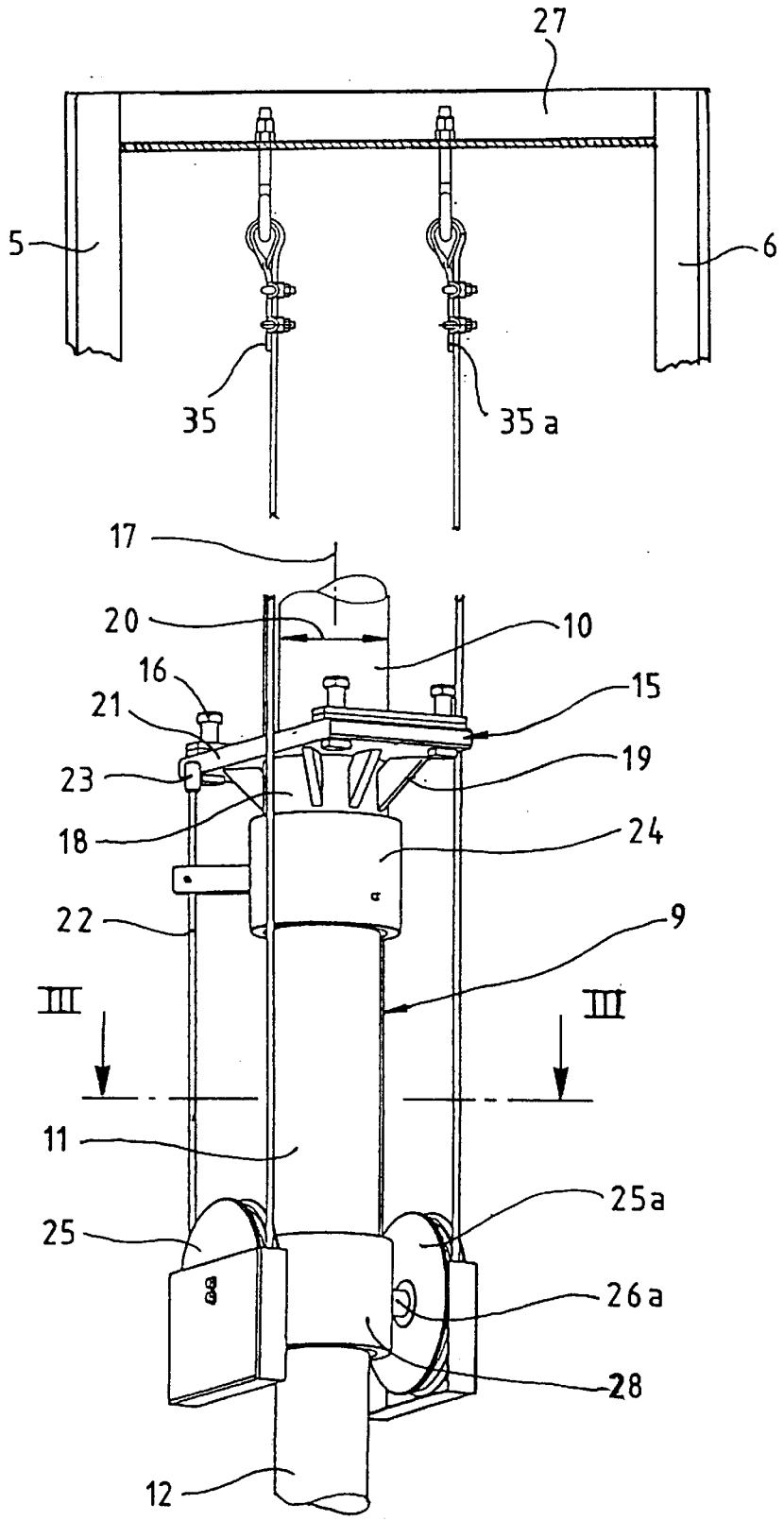
FIG. 2: is a partial view of the telescopic jack of the elevator installation illustrated in FIG. 1.

As is shown in FIG. 2, the supporting plate 15 consists of a welded construction in which a rectangular plate 21 has a centrally positioned circular opening (not shown) whose diameter corresponds to the diameter 20 of the cylinder 10. On the underside of the plate 21 a short length of pipe 18 is welded to it by its end, and coaxial with the circular opening. This serves as a guide to align the supporting plate 15 relative to the longitudinal axis 17 of the cylinder 10. The supporting plate 15 also has gussets 19 which stiffen the plate 21 relative to the short length of the pipe 18.

FIG. 2 shows part of the synchronized telescopic jack 9 with the synchronization device mentioned above, which in the version shown as an example joins the telescopic parts consisting of the cylinder 10 the middle piston 11 and the end piston 12 by means of two so-called 2:1 suspenders. The suspenders are identically constructed, but located on opposite sides of the telescopic jack 9. Each suspender consists of a rope 22, 22*a* (or a chain, or similar), one end 23 of which is fastened to a sleeve 24 of the cylinder 10, and then passes over a sheave 25, 25*a*, thereby having its direction changed by 180 degrees. Then, according to the invention, the rope 22, 22*a* passes in an essentially vertical direction through the floor 14 of the car 1 and through the car 1 itself to a crossbeam 27 at the top end of the hoistway, where the second end 35, 35*a* of the rope 22, 22*a* is fastened. The crossbeam 27 consists of, for example, an L-profile, and forms a rigid connection between the guide rails 5, 6. Due to the connection via the rope 22, 22*a*, the middle piston 11 can for any given travel distance of the cylinder 10 only be extended by half of this distance. Consequently, the partial extensions of each telescopic part 10, 11, 12 are identical for any travel position.

Fastening the two rope ends 35, 35*a* to the crossbeam 27 represents a simplification by comparison with existing methods.

Figure 3:
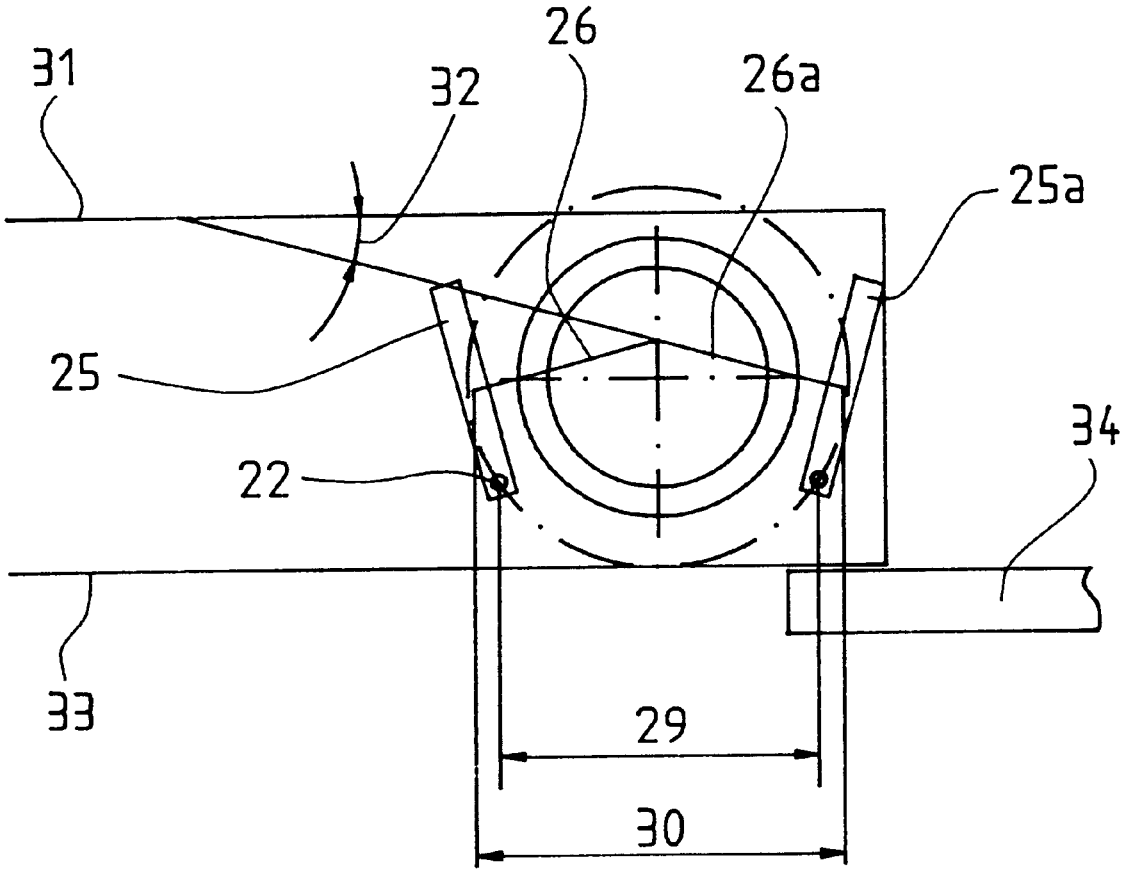
FIG. 3: is a cross-section of the arrangement of the rope sheaves or toothed pulleys taken on the plane III—III and viewed in the direction shown in FIG. 2.

As can be seen in FIG. 3, the sheaves 25, 25*a* located on opposite sides of a sleeve 28 of the middle piston 11 have axes of rotation 26, 26*a* which are not coaxially aligned, but which form in the horizontal plane an acute angle 32 relative to an imaginary line 31 drawn between the two guide rails 5, 6 at the sides. This arrangement of the sheaves 25, 25*a* makes it possible for the ends of the ropes 22, 22*a* that pass through the car 1 to the crossbeam 27 to run closer to the telescopic jack 9, thereby saving space.

The situation described above in relation to a two-stage telescopic jack 9 can be applied correspondingly to multi-stage telescopic jacks.

The invention is not limited by the embodiments described above which are presented as examples only but can be modified in various ways within the scope of protection defined by the appended patent claims.

What is claimed is:

1. A hydraulic elevator, comprising:

a car having a floor;

at least one door;

a guide rail, the car being arranged to ride along the guide rail so that the car is guided along its hoisting travel;

a hydraulic jack having a cylinder and at least one piston which is telescopically extendable from the cylinder, the jack being fixed in position at one end; and means for fastening the cylinder to the floor of the car so that the car moves with the cylinder in its direction of travel, the car floor having an opening therein through which the telescopic jack projects into the car.

2. An elevator according to claim 1, wherein the telescopic jack is located proximate the door.

3. An elevator according to claim 1, wherein the fastening means includes a supporting plate which covers the opening in the floor of the car, which is essentially positioned at right angles to a longitudinal axis of the cylinder, and is fixed to the cylinder in a position along the direction of travel.

4. An elevator according to claim 3, and further comprising means for aligning the supporting plate exactly perpendicular to the cylinder axis.

5. An elevator according to claim 3, wherein the supporting plate has a welded construction.

6. An elevator according to claim 1, wherein the telescopic jack has at least two pistons which can be extended telescopically from the cylinder, and further comprising a mechanical synchronization device which causes partially extended lengths of adjacent telescopic parts of the jack to be equal at any position of travel of the car.

7. An elevator according to claim 6, wherein the synchronization device includes connectors whose upper ends pass in an essentially vertical direction through the floor of the car and through the car itself, and are permanently fastened in position at an appropriate height.

8. An elevator according to claim 7, and further comprising an additional guide rail, the two guide rails being positioned laterally in relation to the telescopic jack, and a crossbeam arranged to join together the rails at a top end of the hoistway, the upper ends of the connectors being fastened to the crossbeam.

9. An elevator according to claim 8, wherein the synchronization device has one of rope sheaves and toothed pulleys whose axes form an acute angle in a horizontal plane relative to an imaginary connecting line drawn between the two guide rails.

* * * * *